US010766752B1

(12) United States Patent
Bennett

(10) Patent No.: US 10,766,752 B1
(45) Date of Patent: Sep. 8, 2020

(54) STACKED PAIL SEPARATION DEVICE

(71) Applicant: Benjamin B. Bennett, San Antonio, TX (US)

(72) Inventor: Benjamin B. Bennett, San Antonio, TX (US)

( * ) Notice: Subject to any disclaimer, the term of this patent is extended or adjusted under 35 U.S.C. 154(b) by 0 days.

(21) Appl. No.: 16/420,339

(22) Filed: May 23, 2019

(51) Int. Cl.
*B25B 27/00* (2006.01)
*B66F 19/00* (2006.01)
*B27L 7/06* (2006.01)

(52) U.S. Cl.
CPC ..... *B66F 19/00* (2013.01); *B25B 27/00* (2013.01); *B27L 7/06* (2013.01); *Y10T 29/53683* (2015.01)

(58) Field of Classification Search
CPC ..... B65G 59/105; B65G 59/005; B65G 2201/0235; B65G 59/10; B65G 59/106; B65G 59/12; E04G 25/066; Y10T 29/53835; Y10T 29/53683; Y10T 24/3969; B66F 15/00; B66F 19/00; Y10S 425/129; B27L 7/06
See application file for complete search history.

(56) References Cited

U.S. PATENT DOCUMENTS 1,233,337 A * 7/1917 Funk ..... A01D 9/00 294/55.5
1,430,369 A * 9/1922 Funk ..... A01D 9/00 294/55.5
1,596,304 A * 8/1926 Reed ..... B66F 15/00 254/131
1,652,478 A * 12/1927 Herman ..... A01G 20/30 294/55.5
1,716,254 A * 6/1929 Walton ..... B25G 3/02 294/55.5
2,345,324 A * 3/1944 Byers ..... B65G 7/12 254/131
4,529,101 A 7/1985 Orlowski et al.
4,742,937 A 5/1988 Blom et al.
4,948,011 A 8/1990 Mueller et al.
5,169,283 A 12/1992 Covert et al.
5,199,571 A 4/1993 Wolff et al.
8,708,383 B1 * 4/2014 Roberts ..... B66F 9/18 294/67.33
8,714,406 B2 5/2014 Miedema et al.
9,624,047 B2 4/2017 Miedema et al.
9,637,326 B2 5/2017 Barr et al.
9,932,146 B1 4/2018 Katz et al.
2010/0194129 A1 * 8/2010 Bouthiette ..... B65G 59/10 294/55.5
2017/0225307 A1 * 8/2017 Bass ..... B25B 27/02

* cited by examiner

*Primary Examiner* — Gregory W Adams
(74) *Attorney, Agent, or Firm* — Cramer Patent & Design, PLLC; Aaron R. Cramer

(57) ABSTRACT

A pail separation device comprised of two halves, each half having a wedge at the end of an exterior brace, an interior brace having a curved face, and which is attached to the exterior brace, and a handle attached to the interior brace and to the exterior brace. Also included is a fastener for locking the two halves together. The two halves further include ridged surfaces that mesh together to reduce slipping. The first and second wedges are dimensioned to fit between pails in a stack of pails such that force applied to the first and second handles can push the first wedge and the second wedge between the pails of a stack of pails so as to separate those pails.

20 Claims, 5 Drawing Sheets

STACKED PAIL SEPARATION DEVICE

FIELD OF THE INVENTION

The presently disclosed subject matter is directed to material handling. More particularly, it is directed to stacked pail separation devices.

BACKGROUND OF THE INVENTION

Many materials come packaged in buckets or pails. For example, plastic five-gallon buckets are very popular for storing and handling a wide variety of materials such as paint, plastics, resins, water, fuel, food products, liquid chemicals, construction materials and the like. Such bucket and pails are slightly tapered and have perimeter lips that provide structural rigidity while also providing handles.

Once such buckets or pails are emptied of their materials, they are often stacked together to reduce clutter and to make handling easier. While some stacked buckets or pails may end up being discarded, because of their value many are transported to another location where they can be cleaned and refilled or re-used for other purposes. This reduces cost while also reducing disposal problems. With stackable buckets and pails their slightly tapered bodies and perimeter lips are designed to assist stacking.

While stackable buckets and pails have proven themselves to be very useful, they do have at least one serious problem. Once stacked removing buckets or pails from the stack can be very difficult. The tight taper tolerances can produce vacuums between stacked elements. Such vacuums can make it extremely difficult to pull buckets or pails apart. Residual materials in the pails as well as dirt or other foreign matter can also tightly bind pails together. Much time can be wasted trying to separate buckets and pails from a stack. Should an entire stack of buckets or pails require separation it may take two people an hour or more of time to do so. Even then there is no guarantee of total success.

Accordingly, there exists a need for a device which can help separate stacked buckets and pails. Preferably, such a device would quickly and easily separate buckets and pails from a stack with minimal effort. Beneficially, such a device would be both rugged and suitable for being made available at low-cost. In practice such a device would provide significant mechanical advantage when separating pails. Ideally, such a device would be suitable for use by one or possibly 2 people and would not require a large amount of area to operate.

SUMMARY OF THE INVENTION

The principles of the present invention provide for devices which help separate stacked buckets and pails. Such devices can quickly and easily separate buckets and pails from a stack. Such devices are suitable for being made available in rugged forms that provide significant mechanical advantages when separating buckets and pails. They can be made available in safe, low-cost implementations suitable for use by one or two people and do not require much area to operate in.

In practice the first exterior brace extends along an exterior side of the first interior brace. Beneficially, the first exterior brace forms an outer edge of the first interior brace. A gusset plate should be connected to the first exterior brace and to the first handle to provide additional structural strength. In practice, the front of the first interior brace is curved to mate with pails in a stack of pails, in any event the first interior plate may include a first slotted channel while the second interior plate may include a second slotted channel. If so, the fastener passes through the first slotted channel and through the second slotted channel and locks the first half to the second half. The distance between the first wedge and the second wedge can be varied by adjusting the position of the first channel relative to the second channel. In addition, there should be first ridged surfaces on the first half and second ridged surfaces on the second half. The first ridged surfaces and the second ridged surfaces should mesh together when the fastener locks the first half to the second half.

Another pail separation device that is in accord with the present invention comprises a first wedge at the end of a first exterior brace, a first interior brace that is attached to the first exterior brace, and a first handle that is attached to the first interior brace and to the first exterior brace. In addition, there is a second wedge at the end of a second exterior brace, a second interior brace attached to the second exterior brace, and a second handle that is attached to the second interior brace and to the second exterior brace. A fastener is included for locking the first interior brace to the second interior braces such that the first handle aligns with the second handle. The first interior brace overlaps the second interior brace when they are locked together.

In that alternative pail separation device, the first wedge and the second wedge are dimensioned to fit between pails in a stack of pails. Force applied to the first handle and to the second handle pushes the first wedge and the second wedge between pails of a stack of pails such that the first wedge and the second wedge separate those pails. In practice, the first interior plate includes a first slotted channel while the second interior plate include a second slotted channel. In that case the fastener passes through the first slotted channel and through the second slotted channel. In any event the distance between the first wedge and the second wedge can be varied by adjusting the position of the first channel relative to the second channel. There may be first ridged surfaces on the first interior brace and second ridged surfaces on the second interior braces. If so, the first ridged surfaces and the second ridged surfaces mesh together when the fastener locks the first interior brace to the second interior brace.

In yet another pail separation device that is in accord with the present invention there is a first interior brace having a first channel, a first wedge at one end of a first exterior brace, that exterior brace is attached to the first interior brace, and there is a first handle that is attached to the first interior brace and to the first exterior brace opposite the first wedge. In addition, there is a second interior brace having a second channel, a second wedge at one end of a second exterior brace that is attached to the second interior brace, and a second handle that is attached to the second interior brace and to the second exterior brace. A fastener passes through the first channel and through the second channel to lock the first interior brace to the second interior brace.

With that pail separation device the first wedge and the second wedge are dimensioned to fit between pails in a stack of pails such that force applied to the first handle and to the second handle pushes the first wedge and the second wedge between pails of a stack of pails to separate them. Beneficially, the front of the first interior brace is curved. There may be first ridged surfaces on the first interior brace and second ridged surfaces on the second interior brace. In that case the first ridged surfaces and the second ridged surfaces mesh together when the fastener locks the first interior brace to the second interior brace.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
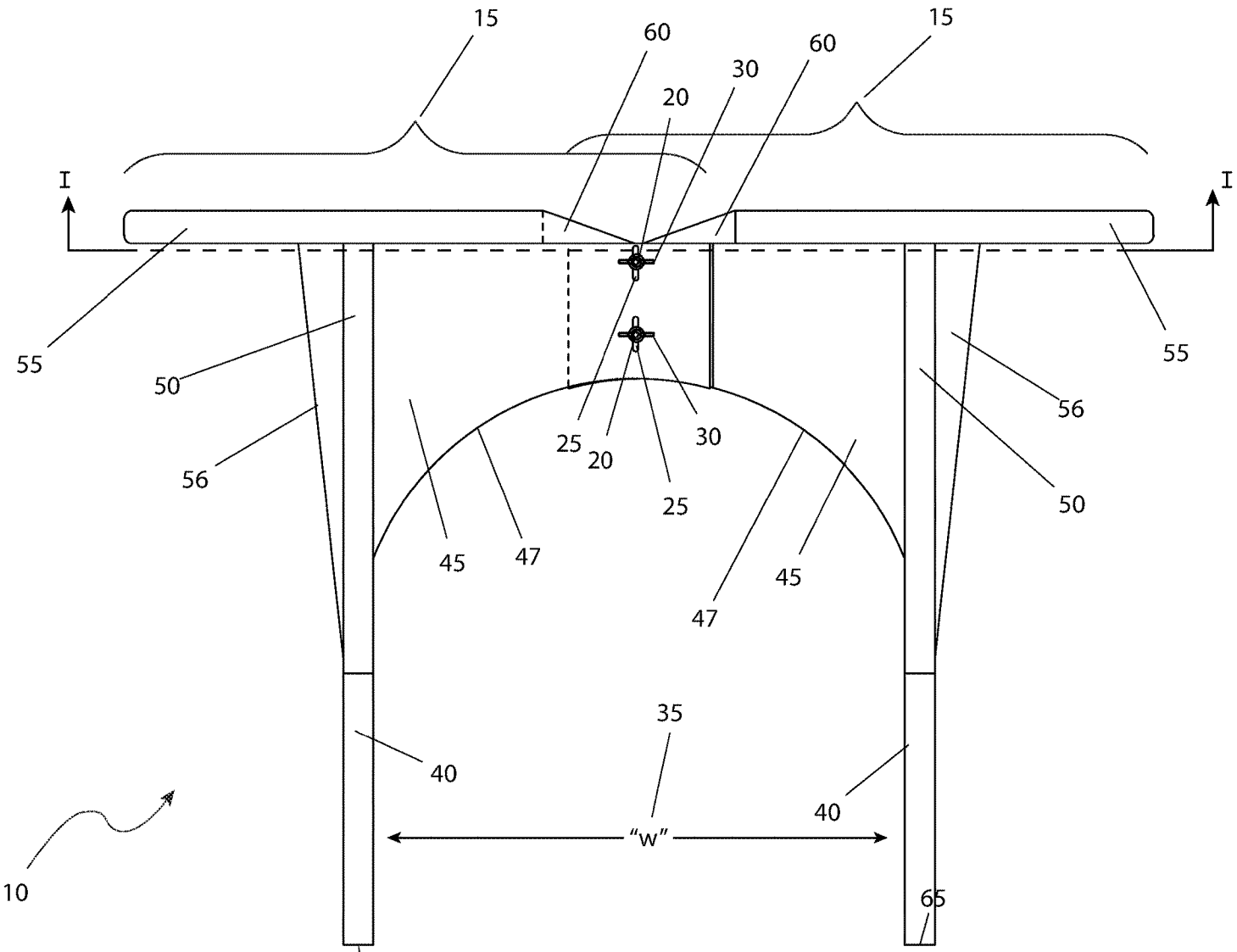
FIG. 1 is a front view of a separation device 10 that is in accord with the principles of the present invention.

10 separation device
15 halves
20 bolts
25 wing nuts
30 slotted channel
35 width dimension
40 wedge
45 interior brace
47 curved front surface
50 exterior brace
51 lip
55 handle
56 gusset plate
60 overlapping section
65 wedge point
70 ridged surface
75 stack of pails
80 pail
85 gap
90 pressure "p"

DETAILED DESCRIPTION OF THE INVENTION

The preferred embodiment of the present invention is depicted in FIGS. 1 through 5. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one of the referenced items.

Figure 5:
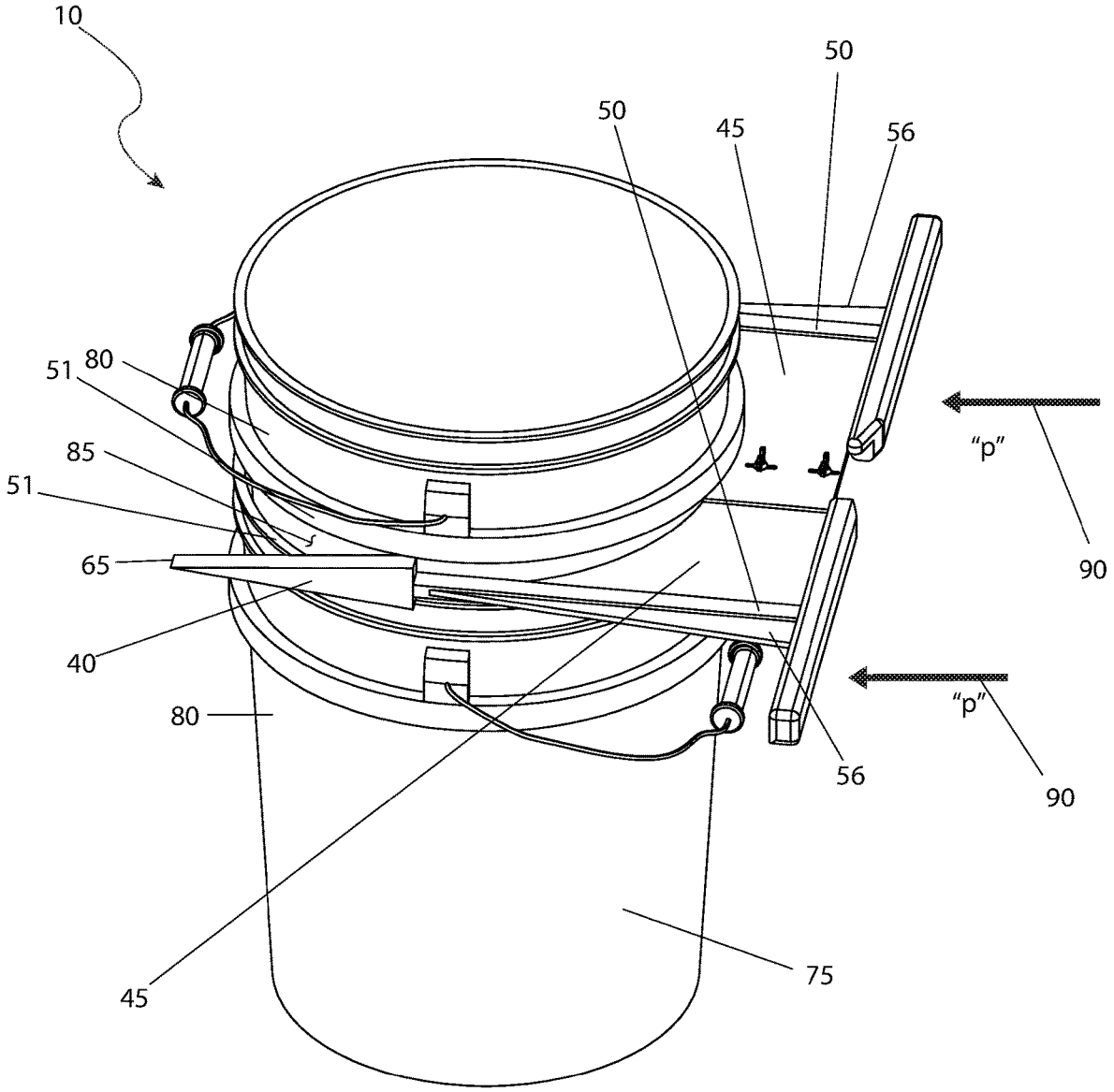

FIG. 5 illustrates a separation device 10 that is in accord with the present invention in use separating pails 80. FIG. 1 presents a top-down view of the separation device 10 without pails 80. With reference primarily to FIG. 1 the separation device 10 has two (2) halves 15 which can be joined together back-to-back. The two halves 15 can be locked together by two (2) bolts 20 and two (2) wing nuts 25. The bolts 20 pass-through slotted channels 30 in the two halves 15. The slotted channels 30 enable adjustment of the relative positions of the halves 15 to allow the separation device 10 to work with buckets and pails of different diameters.

Figure 2:
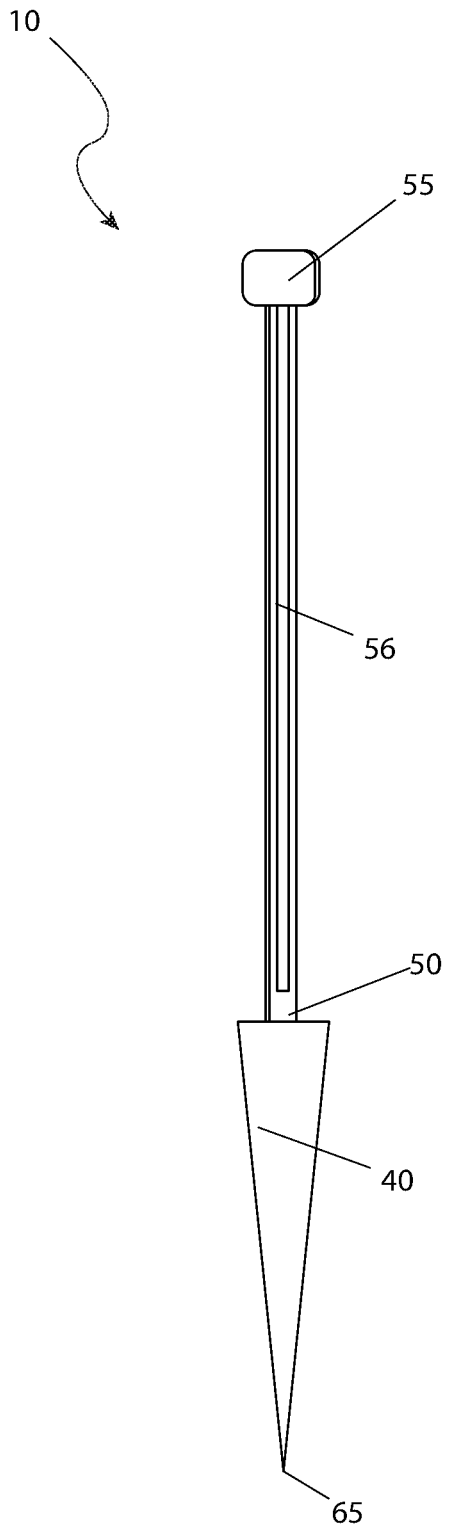
FIG. 2 is a side view of the separation device 10 shown in FIG. 1.

Referring now also to FIG. 2, each half 15 includes a triangular wedge 40 that ends in a wedge point 65. Each wedge 40 is located at the end of an exterior brace 50. Each exterior brace 50 extends along an exterior side of and then past an associated interior brace 45. Each exterior brace 50 forms an outer edge of its associated interior brace 45.

Still referring to FIGS. 1 and 5, the front of each interior brace 45 has a curved front surface 47. When the interior braces 45 are locked together the curved front surfaces 47 of the interior braces 45 form a curved front which is designed to mate with the outer surface of a pail 80.

Turning now primarily to FIG. 1, each interior brace 45 and its associated exterior brace 50 extends from a handle 55. That handle 55 forms the back edge of the interior brace 45. In use, when the interior braces 45 are connected together by the bolts 20 and wing nuts 25 they form overlapping sections 60 such that the handles 55 axially align. To provide additional structural strength each exterior brace 50 and handle 55 are connected together and supported by a gusset plate 56. Each gusset plate 56 extends along the exterior surface of its associated exterior brace 50 and along the front of the handle 55.

While further details regarding the construction and configuration of the halves 15 is provided below, it is envisioned that each of the halves 15 would be manufactured of heavy-duty impact resistant plastic using an injection molding process. However, other materials, including, but not limited to, steel, aluminum, wood, and the like may also be used if they provide benefit for the particular application.

The separation device 10 would find particular utility with standard, readily-available pails 80, such as the five gallon (5 Gal) buckets commonly used to hold, carry, and deliver common liquid, powder, or semi-liquid products used in various fields such as food, construction, and the like. By adjusting the width dimension 35 of FIG. 1 a separation device 10 can accommodate dimensional variations in such pails 80 as well as enabling use with other types of buckets and pails. This is important because pails can range from very small pails 80 such as pints, quarts, or the like, up to large pails 80 capable of handling ten gallons (10 Gal), fifteen gallons (15 Gal) or even more. As such, the specific dimensions of a separation device 10 may vary as required to work in the specific application.

However, a highly beneficial embodiment is well-suited to accommodate 5-gallon pails 80. In such applications the overall length of the exterior brace 50 and wedge 40 of each half 15 should be approximately fifteen and one-half inches (15½ in.) with the wedge 40 accounting for approximately nine inches (9 in.) of that length. Referring now specifically to FIG. 5, the wedge 40 is further configured such that it can be pushed between the perimeter lips 85 of adjacent pails 80 of a stack of pails 75. Such perimeter lips 85 are common as they impart structural strength and rigidity to the pails 80. The relative positions of the connected-together inner braces 45 can be adjusted by the fastener 20 to locate the wedge points 65 of the wedges 40 with the proper separation to fit between the perimeter lips 85 of adjacent pails 80.

FIG. 2 illustrates how the wedges 40 taper to the wedge points 65 that aid in the separation of pails 80 by providing a mechanical advantage.

Figure 3:
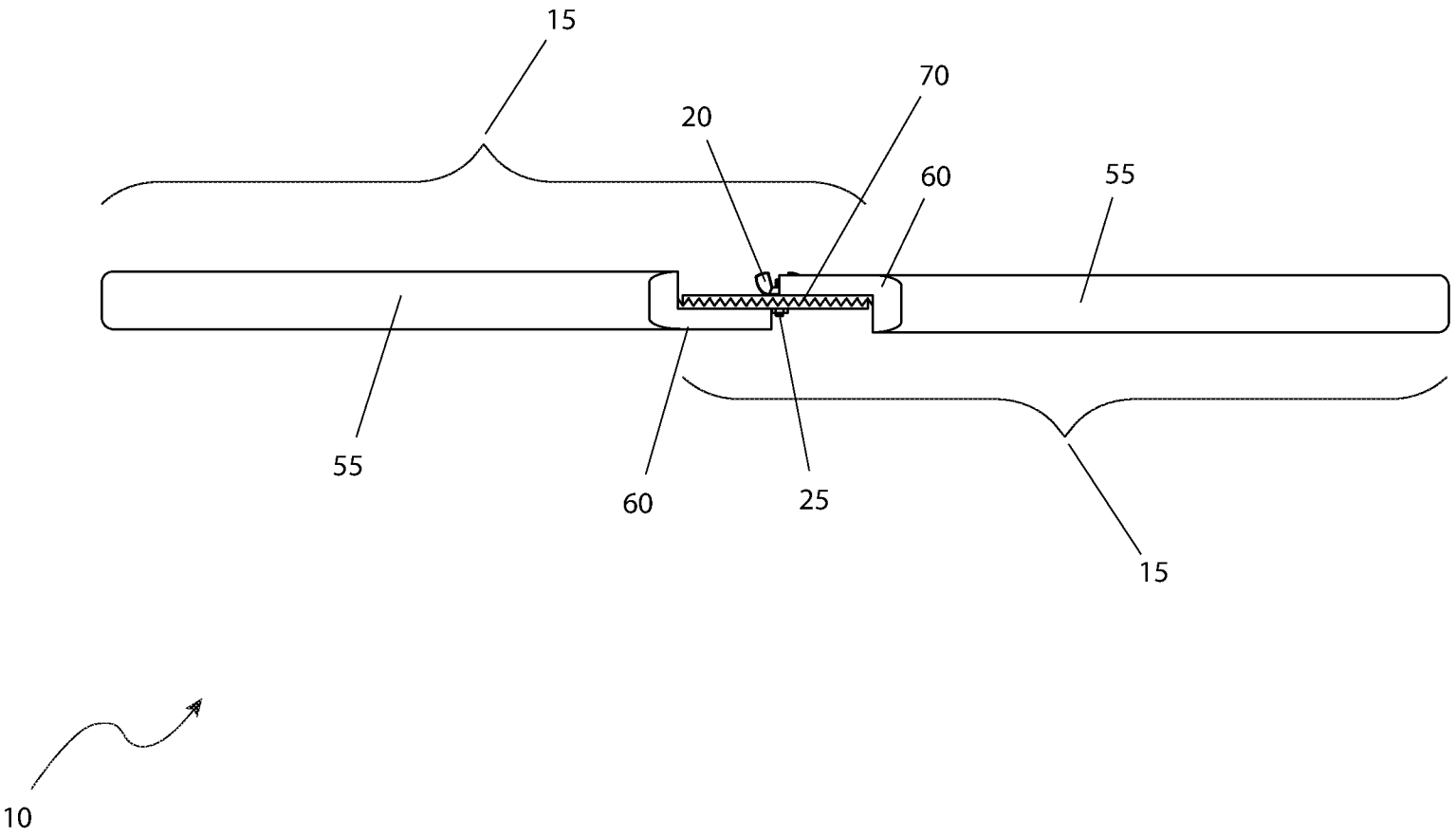
FIG. 3 is a top view of the separation device 10 shown in FIGS. 1 and 2.

FIG. 3 presents a rear view of overlapped sections 60. As shown, the overlapped sections 60 have ridged surfaces 70 that are linearly arranged so as to mesh together when the two halves are locked together. The meshed rigid surfaces 70 act to hold each half 15 in a desired position so as to prevent slippage or other movement. The locking of the two halves 15 together by the bolts 20 and wing nuts 25 with the interlocking ridged surfaces 70 meshed together assist both alignment and rigidity.

Figure 4:
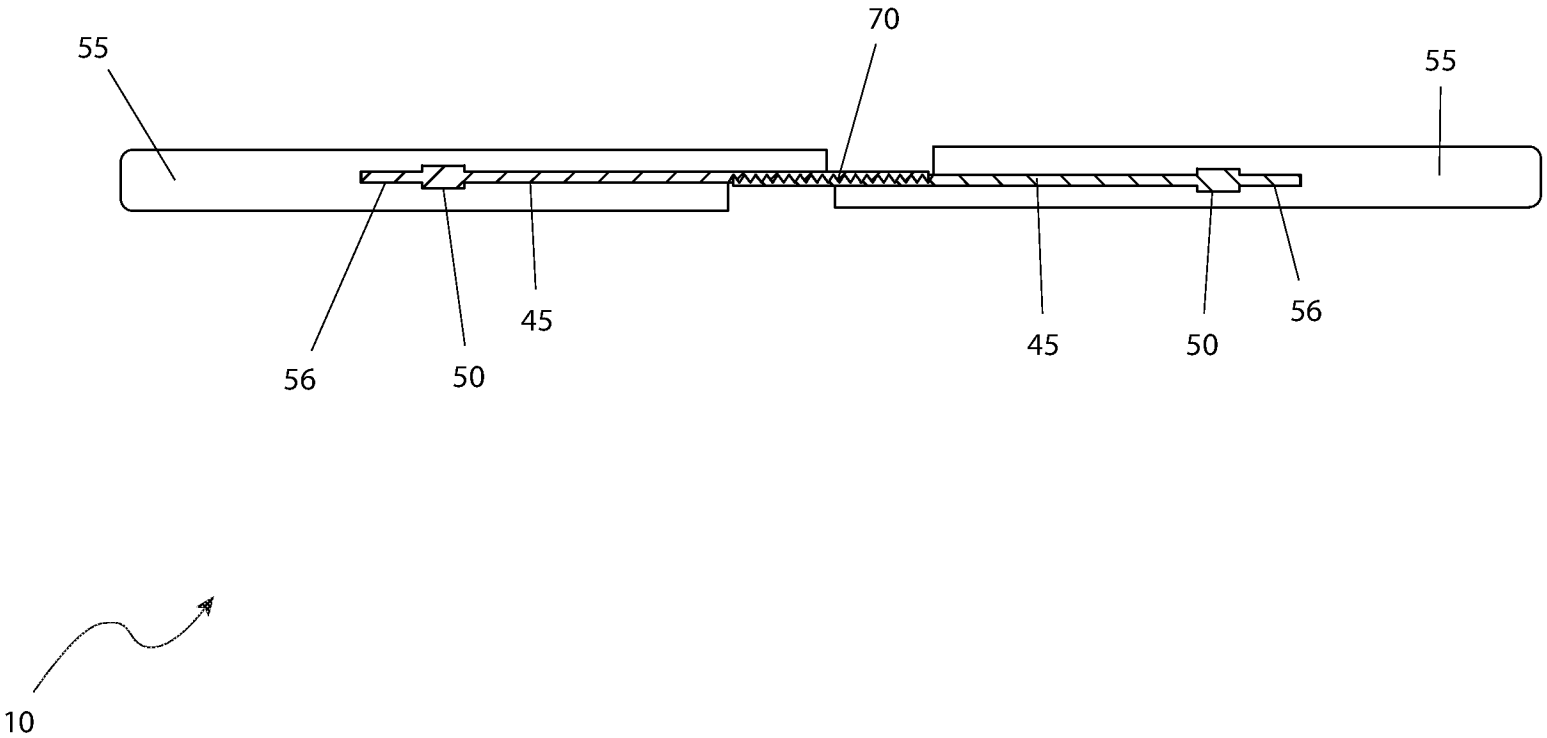
FIG. 4 is a cut-away view of the separation device 10 taken along line I-I of FIG. 1; and, FIG. 5 is a perspective view of the separation device 10 in use.

FIG. 4 presents a cut-away view of the separation device 10 taken along line I-I of FIG. 1. As such, it shows a similar view as FIG. 3, but with more internal structural details. As noted, the ridged surfaces 70 aid in setting and maintaining the desired spacing of the exterior brace 50 and wedge 40 of each half 15 while preventing slippage. The handles 55 provide adequate spacing and surface area for the application of force by two (2) hands. It is noted that both halves 15 are beneficially symmetrical, thus requiring only a single pattern to be used during manufacturing.

FIG. 5 illustrates a separation device 10 being used on a stack of pails 75 of pails 80. With the stack of pails 75 in a horizontal position the wedge point 65 of each wedge 40 is inserted into a gap 85 between the lips 51 of two (2) pails 80. The user applies pressure "p" 90 via their hands such that the wedge point 65 wedges the pails 80 apart. The shape of the wedges 40 provides mechanical advantage as the wedges 40 move into the gap 85 so as to separate the pails 80. That process may repeat until all pails 80 are separated.

The preferred embodiment of the present invention can be utilized by the common user in a simple and effortless manner with little or no training. It is envisioned that the separation device 10 would be constructed in general accordance with FIGS. 1 through 5. The user would procure the separation device 10 through conventional procurement channels such as home improvement stores, material supply houses, mail order or internet stores or the like. Special attention would be paid to the overall size of the pails 80 that it is intended to be used with. While minor variations in size can be accommodated by the slotted channels 30, ridged surface 70, bolts 20, and wing nuts 25, different sized pails might require different sizes of separation devices 10.

After procurement and prior to utilization, the separation device 10 would be prepared by adjusting the overall width dimension 35 in the following manner: the two (2) bolts 20 and wing nuts 25 would be removed; the two (2) halves 15 would be aligned using the joining ridged surfaces 70 and temporarily placed against the stack of pails 75 to be separated; minor manipulation of the desired ridged surfaces 70 would be performed until the width dimension 35 is satisfactory; the two (2) bolts 20 and wing nuts 25 would be inserted into the two (2) slotted channels 30 and joined together by finger tightening. The separation device 10 is then ready for use.

During use, the stack of pails 75 to be separated would be placed on its side on a solid surface; the wedge points 65 of the wedges 40 would be positioned in the gap 85 between two (2) pails 80; the user would then apply pressure "p" 90 via their hands in a downward manner; as the ever-increasing width of the wedges 40 moves into the gap 85 it exerts a tremendous amount of leveraged force on the pails 80 thus driving them apart and separating them; once separated, the separation device 10 is moved to the next gap 85 in the stack of pails 75, and the process is repeated until all pails 80 are separated. After use the separation device 10 would be stored for future.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated.

What is claimed is:

1. A pail separation device, comprising:
- a first half including a first wedge at the end of a first exterior brace, a first interior brace attached to said first exterior brace, and a first handle attached to said first interior brace and to said first exterior brace;
- a second half including a second wedge at the end of a second exterior brace, a second interior brace attached to said second exterior brace, and a second handle attached to said second interior brace and to said second exterior brace; and
- a fastener for locking said first half to said second half;
- wherein said first wedge and said second wedge are dimensioned to fit between pails in a stack of pails; and
- wherein force applied to said first handle and to said second handle can push said first wedge and said second wedge between pails of a stack of pails such that said first wedge and said second wedge separate pails.

2. The pail separation device according to claim 1, wherein said first wedge terminates in a first wedge point dimensioned to slide between pails in a stack of pails.

3. The pail separation device according to claim 1, wherein said first exterior brace extends along an exterior side of said first interior brace.

4. The pail separation device according to claim 3, wherein said first exterior brace forms an outer edge of said first interior brace.

5. The pail separation device according to claim 4, further including a gusset plate connected to said first exterior brace and to said first handle.

6. The pail separation device according to claim 1, wherein the front of said first interior brace is curved to mate with a pail.

7. The pail separation device according to claim 6, wherein said first interior plate includes a first slotted channel and wherein said second interior plate includes a second slotted channel.

8. The pail separation device according to claim 7, wherein said fastener passes through said first slotted channel and through said second slotted channel.

9. The pail separation device according to claim 8, wherein the distance between said first wedge and said second wedge is variable by adjusting said first channel relative to said second channel.

10. The pail separation device according to claim 9, further including first ridged surfaces on said first half and second ridged surfaces on said second half, wherein said first ridged surfaces and said second ridged surfaces mesh together when said fastener locks said first half to said second half.

11. A pail separation device, comprising:
- a first wedge at the end of a first exterior brace;
- a first interior brace attached to said first exterior brace;
- a first handle attached to said first interior brace and to said first exterior brace;
- a second wedge at the end of a second exterior brace,
- a second interior brace attached to said second exterior brace;
- a second handle attached to said second interior brace and to said second exterior brace; and
- a fastener for locking said first interior brace to said second interior braces such that said first handle aligns with said second handle;

wherein said first interior brace overlaps said second interior brace.

12. The pail separation device according to claim 11, wherein said first wedge and said second wedge are dimensioned to fit between pails in a stack of pails.

13. The pail separation device according to claim 12, wherein force applied to said first handle and to said second handle can push said first wedge and said second wedge between pails of a stack of pails such that said first wedge and said second wedge separate those pails.

14. The pail separation device according to claim 13, wherein said first interior plate includes a first slotted channel, wherein said second interior plate include a second slotted channel, and wherein said fastener passes through said first slotted channel and through said second slotted channel.

15. The pail separation device according to claim 14, wherein the distance between said first wedge and said second wedge can be varied by adjusting the position of said first channel relative to said second channel.

16. The pail separation device according to claim 15, further including first ridged surfaces on said first interior brace, second ridged surfaces on said second interior braces, and wherein said first ridged surfaces and said second ridged surfaces mesh together when said fastener locks said first interior brace to said second interior brace.

17. A pail separation device, comprising:

a first interior brace having a first channel;

a first wedge at one end of a first exterior brace, said first exterior brace attached to said first interior brace;

a first handle attached to said first interior brace and to a second end of said first exterior brace;

a second interior brace having a second channel;

a second wedge at one end of a second exterior brace, said second exterior brace attached to said second interior brace;

a second handle attached to said second interior brace and to said second exterior brace; and a fastener passing through said first channel and through said second channel, said fastener locking said first interior brace to said second interior brace.

18. The pail separation device according to claim 17, wherein said first wedge and said second wedge are dimensioned to fit between pails in a stack of pails such that a force applied to said first handle and to said second handle pushes said first wedge and said second wedge between pails of a stack of pails to separate them.

19. The pail separation device according to claim 18, wherein the front of said first interior brace is curved.

20. The pail separation device according to claim 19, further including first ridged surfaces on said first interior brace and second ridged surfaces on said second interior brace, wherein said first ridged surfaces and said second ridged surfaces mesh together when said fastener locks said first interior brace to said second interior brace.

* * * * *